US008226344B2

(12) United States Patent
Osanai et al.

(10) Patent No.: US 8,226,344 B2
(45) Date of Patent: Jul. 24, 2012

(54) WORKING MACHINE

(75) Inventors: Masashi Osanai, Kanagawa (JP); Toru Shiina, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 12/087,644

(22) PCT Filed: Jul. 31, 2006

(86) PCT No.: PCT/JP2006/315127

§ 371 (c)(1),
(2), (4) Date: Jul. 11, 2008

(87) PCT Pub. No.: WO2007/080668

PCT Pub. Date: Jul. 19, 2007

(65) Prior Publication Data

US 2009/0003984 A1 Jan. 1, 2009

(30) Foreign Application Priority Data

Jan. 13, 2006 (JP) ..... 2006-006566

(51) Int. Cl.
*B66C 23/00* (2006.01)

(52) U.S. Cl. ..... 414/697; 414/685

(58) Field of Classification Search ..... 414/685, 414/697, 700, 706, 708
See application file for complete search history.

(56) References Cited

U.S. PATENT DOCUMENTS

| | | | |
|---|---|---|---|
| 2,876,921 | A | 3/1959 | Salna |
| 2,926,799 | A | 3/1960 | Granryd |
| 2,959,306 | A | 11/1960 | Kampert |
| 3,274,710 | A | 9/1966 | Wright |
| 3,321,215 | A | 5/1967 | Kampert |
| 3,411,647 | A | 11/1968 | Zimmerman |
| 4,154,349 | A | 5/1979 | Christensen |
| 5,201,235 | A | 4/1993 | Sutton |
| 5,501,570 | A | 3/1996 | Mozingo |
| 6,309,171 | B1 | 10/2001 | Arch et al. |
| 2006/0291987 | A1 | 12/2006 | Osanai et al. |

FOREIGN PATENT DOCUMENTS

| | | | |
|---|---|---|---|
| DE | 29 48 480 | A1 | 6/1981 |
| FR | 1 523 548 | A | 5/1968 |
| FR | 2 727 998 | A1 | 6/1996 |

(Continued)

OTHER PUBLICATIONS

"Construction Machinery Photo Collection", Japan Industrial Publishing Co., Ltd., Feb. 15, 1970.

(Continued)

*Primary Examiner* — Donald Underwood
(74) *Attorney, Agent, or Firm* — Holtz, Holtz, Goodman & Chick, P.C.

(57) ABSTRACT

An angle formed on a side of a bucket by a first line segment that connects a first pivot region of a bell crank relative to a boom and a second pivot region of the bell crank relative of a connecting link and a second line segment that connects the first pivot region and third a pivot region of the bell crank relative to a tilt cylinder is no more than 206.5°. An angle formed by the second line segment and a line segment that connects the third pivot region and fourth a pivot region of the tilt cylinder relative to a structural body is, in a fork-attached state, no more than 72.3°. When a pivot region of the fork relative to the boom is substantially 1.5 m from the ground, a lower end of the bell crank is located higher than a lower end of the fork.

2 Claims, 13 Drawing Sheets

FOREIGN PATENT DOCUMENTS

| | | | |
|---|---|---|---|
| JP | 43-1693 | B | 1/1968 |
| JP | 63-22499 | A | 1/1988 |
| JP | 01-295922 | A | 11/1989 |
| JP | 6-10287 | U | 2/1994 |
| JP | 6-293498 | A | 10/1994 |
| JP | 2838251 | B2 | 10/1998 |
| JP | 11-343631 | A | 12/1999 |
| WO | WO 2005/012653 | A1 | 2/2005 |

OTHER PUBLICATIONS

U.S. Appl. No. 11/814,903, filed Jul. 26, 2007, entitled: Work Machine, inventor: M. Osanai.

Final Office Action dated Apr. 23, 2009 in related U.S. Appl. No. 10/566,484.

International Preliminary Report on Patentability, Chapter I of the Patent Cooperation Treaty, undated, for PCT/JP2006 /315127. 6 sheets.

WORKING MACHINE

This application is a U.S. National Phase Application under 35 USC 371 of International Application PCT/JP2006/315127 filed Jul. 31, 2006.

TECHNICAL FIELD

The present invention relates to a work machine.

BACKGROUND ART

Conventionally, a wheel loader is known as a work machine. In a wheel loader, an attachment such as a bucket or the like is provided at a distal end of a boom pivoted on a vehicle body, the boom is provided in a manner movable up and down by a boom cylinder, and the bucket is driven via a Z-shaped link.

As shown in FIG. 15, the Z-shaped link includes a bell crank 11 rotatably pivoted substantially on the central portion of the boom 10, a tilt cylinder (see dashed lines) connecting an upper end of the bell crank 11 and the vehicle body (not shown), and a connecting link 13 that connects a lower end of the bell crank 11 and a rear portion of the bucket 20.

Incidentally, in FIG. 15, the boom cylinder and the tilt cylinder are omitted to simplify the figure. A pivot region (pivoting region) Z of the tilt cylinder relative to the vehicle body is drawn on the boom 10 in the figure, but actually is disposed on the vehicle body (not shown), not on the boom 10. In FIG. 15, the bucket 20 at a ground position, an intermediate position, and an uppermost maximum height position is shown.

In such a wheel loader, a digging operation is carried out with the bucket 20 disposed near the ground position, and a loading operation is carried out such that a load is dumped onto a truck from the intermediate position or a top position. The dumping accompanies so-called "load leveling", that is, leveling topside of earth and sand loaded on a dump truck or the like. The "load leveling", in which a height of the bucket 20 is adjusted mostly via an operation of the boom cylinder, is not efficiently conducted unless an angle of a lower surface 21 of the bucket 20 is horizontal.

In order to start the digging operation immediately after having loaded earth and sand onto a dump truck or the like, the work machine is provided with a function called automatic leveler for activating the tilt cylinder to change the angle of the lower surface 21 of the bucket 20 to a horizontal state on the ground position without a manual operation by an operator. If the lower surface 21 of the bucket 20 in the maximum height position is greatly tilted downward toward a distal end thereof, the bucket 20 contacts with a loading space of the dump truck or the like when the wheel loader is receded, thereby blocking the receding movement of the wheel loader.

Further, if the distal end of the lower surface 21 of the bucket 20 at a maximum height thereof is tilted downward, the earth, sand, and the like drop onto the ground when the wheel loader is receded, which may cause troubles to the operations.

Therefore, an angle of the lower surface 21 of the bucket 20 when lifted from the ground level position to the maximum height position without operating the tilt cylinder is preferably as close to horizontal as possible.

Taking the above into consideration, angle characteristics of the attachment is improved in a wheel loader (disclosed in, e.g. Patent Document 1). According to such improvement, the bell crank 11 is tilted toward the attachment or not tilted at all when the bucket 20 is on the ground.

In addition, a wheel loader in which a fork is combined with the Z-shaped link is also known (e.g. Patent Document 2).

Patent Document 1: WO2005-012653
Patent document 2: JP-A-63-22499

DISCLOSURE OF THE INVENTION

Problems to be Solved by the Invention

However, at a height at which a normal loading operation of a wheel loader disclosed in Patent Document 1 in a fork-attached state is carried out, that is, at a height at which a pivot region of a fork relative to a boom is substantially 1.5 m high from the ground level, a lower end of a bell crank is located lower than a lower end of the lower surface of the fork, so that the bell crank interferes with a load vehicle during a loading operation.

When a bucket is attached to a wheel loader disclosed in Patent Document 2 instead of a fork and the bucket is lifted to a maximum height position, a downward angle between a distal end of the lower surface of the bucket and the horizontal plane is widened. Accordingly, before an operator attempts to dump the earth and sand loaded on the bucket onto the loading space of the truck or the like, the bucket undesirably dumps the earth and sand as the boom is elevated higher and higher, thereby hindering a loading operation onto a dump truck at an intended height.

An object of the present invention is to provide a work machine in which an angle of the lower surface of the bucket is not greatly changed and a bucket lifted to a maximum height thereof is kept substantially horizontal, the work machine in either a bucket-attached state or a fork-attached state being less likely to be interfered with by a loading machine such as a dump truck.

Means for Solving the Problems

A work machine according to an aspect of the present invention includes: a boom whose first end is attached to a structural body that supports a working equipment; a bucket or a fork exchangeably attached to a second end of the boom; a bell crank attached to a location halfway in a longitudinal direction of the boom; a tilt cylinder whose first end is pivoted on the structural body and whose second end is attached to a first end of the bell crank; and a connecting link that connects a second end of the bell crank and the bucket or the fork. In this structure, when the bucket or the fork attached to the second end of the boom is at a ground horizontal position and a lower surface of the bucket or a lower surface of the fork is on the ground: the tilt cylinder is attached to an upper end portion of the bell crank, and the connecting link is connected to a lower end portion of the bell crank. In addition, when the bucket or the fork attached to the second end of the boom is at the ground horizontal position and the lower surface of the bucket or the lower surface of the fork is on the ground: an angle θ formed on a side of the bucket or on a side of the fork by a first line segment that connects a pivot region of the bell crank relative to the boom and a pivot region of the bell crank relative of the connecting link and a second line segment that connects the pivot region of the bell crank relative to the boom and a pivot region of the bell crank relative to the tilt cylinder satisfies $0\ (\text{deg}) < \theta \leqq 206.5\ (\text{deg})$. Still further, when the fork is attached to the second end of the boom and is at the ground horizontal position and the lower surface of the fork is on the around: an angle α formed by the second line segment and a line segment that connects the pivot region of the bell crank relative to the tilt cylinder and a pivot region of the tilt cylinder relative to the structural body satisfies α≦73.2 (deg). And when the fork is attached to the second end of the boom and a pivot region of the fork relative to the boom is substantially 1.5 m high from the ground, a lower end of the bell crank is located higher than a lower end of the fork.

Here, the downward angle permissible at the maximum height position is determined based on a maximum coefficient μ of static friction applied between loaded earth and sand and an inner bottom surface of the bucket and on an acceleration G applied to the bucket when the working equipment of the work machine is operated.

According to the aspect of the present invention, by setting the angle θ formed on the side of the bucket by the first line segment and the second line segment of the bell crank to be 206.5 (deg) or less and the angle α formed by the second line segment of the bell crank and a center line of the tilt cylinder to be 73.2 (deg) or less, the downward angle ω of the distal end of the lower surface of the bucket at the maximum height position can be set to be 10 (deg) or less. Therefore, the loaded earth and sand is prevented form dropping without tilting of the bucket, so that the work machine that can employ both the bucket and the fork can be provided.

In addition, when the pivot region of the fork relative to the boom is 1.5 m high from the ground in the fork-attached state, the lower end of the bell crank is located higher than the lower end of the fork, so that the bell crank is prevented from interfering with a dump truck or the like during a loading operation, thereby enabling an efficient loading operation.

In the above arrangement, when the bucket is at a maximum height position, a downward angle ω between a distal end of the lower surface of the bucket and a horizontal plane preferably satisfies ω≦10 (deg).

With this arrangement, when the bucket is at the maximum height position, the downward angle between the distal end of the lower surface of the bucket and the horizontal plane is 10 (deg) or less, so that, when the bucket is tilted to a maximum height position, the loaded earth and sand does not drop out of the bucket.

In the above arrangement, when the bucket or the fork attached to the second end of the boom is at a ground horizontal position and a lower surface of the bucket or a lower surface of the fork is on the ground: a line segment that connects the pivot region of the tilt cylinder relative to the structural body and a pivot region of the boom relative to the structural body preferably is inclined downward toward the bucket or toward the fork to a horizontal plane.

With this arrangement, the pivot region of the tilt cylinder relative to the structural body is disposed at a position forward and downward with respect to the pivot region of the boom relative to the structural body, so that the trajectory of the pivot region W of the bell crank relative to the tilt cylinder is described around the pivot region of the tilt cylinder relative to the structural body. Accordingly, the angle variation of the bucket in accordance with the elevation of the boom decreases, and the bucket lifted to the maximum height position is kept substantially horizontal.

In the above arrangement, when the fork is positioned at the ground horizontal position and the lower surface of the fork is fully tilted from the ground horizontal position, the entire bell crank preferably is located adjacent to the structural body relative to an extension line that extends upward from a rear surface of the fork.

With this arrangement, when the fork is at the ground horizontal position and the lower surface of the fork is fully tilted from the ground position, the whole of the bell crank is disposed closer to the boom than the rear surface of the fork, so that the loads of the fork does not interfere with the bell crank even when the fork is at the ground horizontal position, thereby preventing the loads from being damaged or dropped.

BEST MODE FOR CARRYING OUT THE INVENTION

Embodiment(s) of the present invention will be described below with reference to the drawings.

Figure 1:
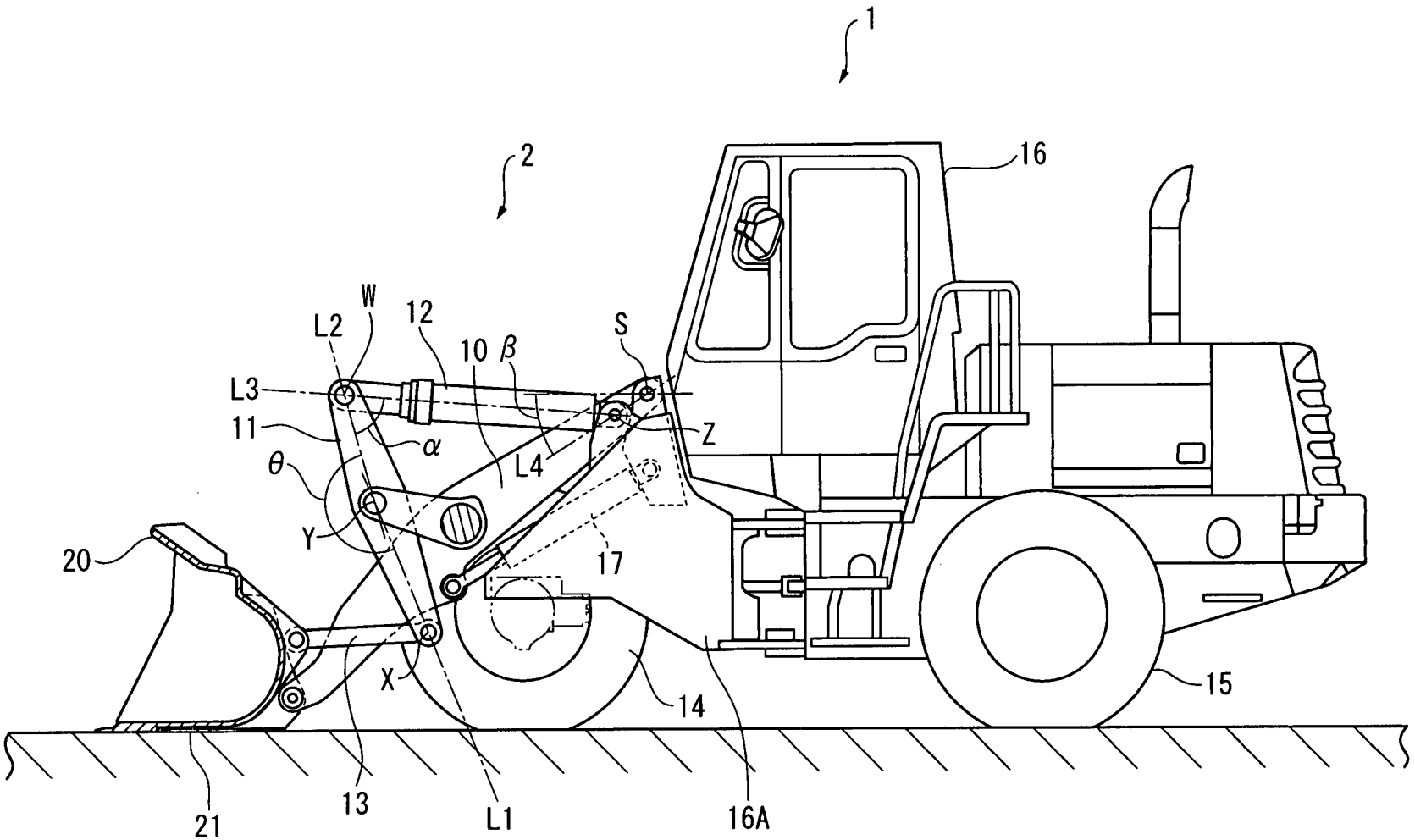
FIG. 1 is a side view showing a structure of a work machine according to an embodiment of the present invention.
Figure 2:
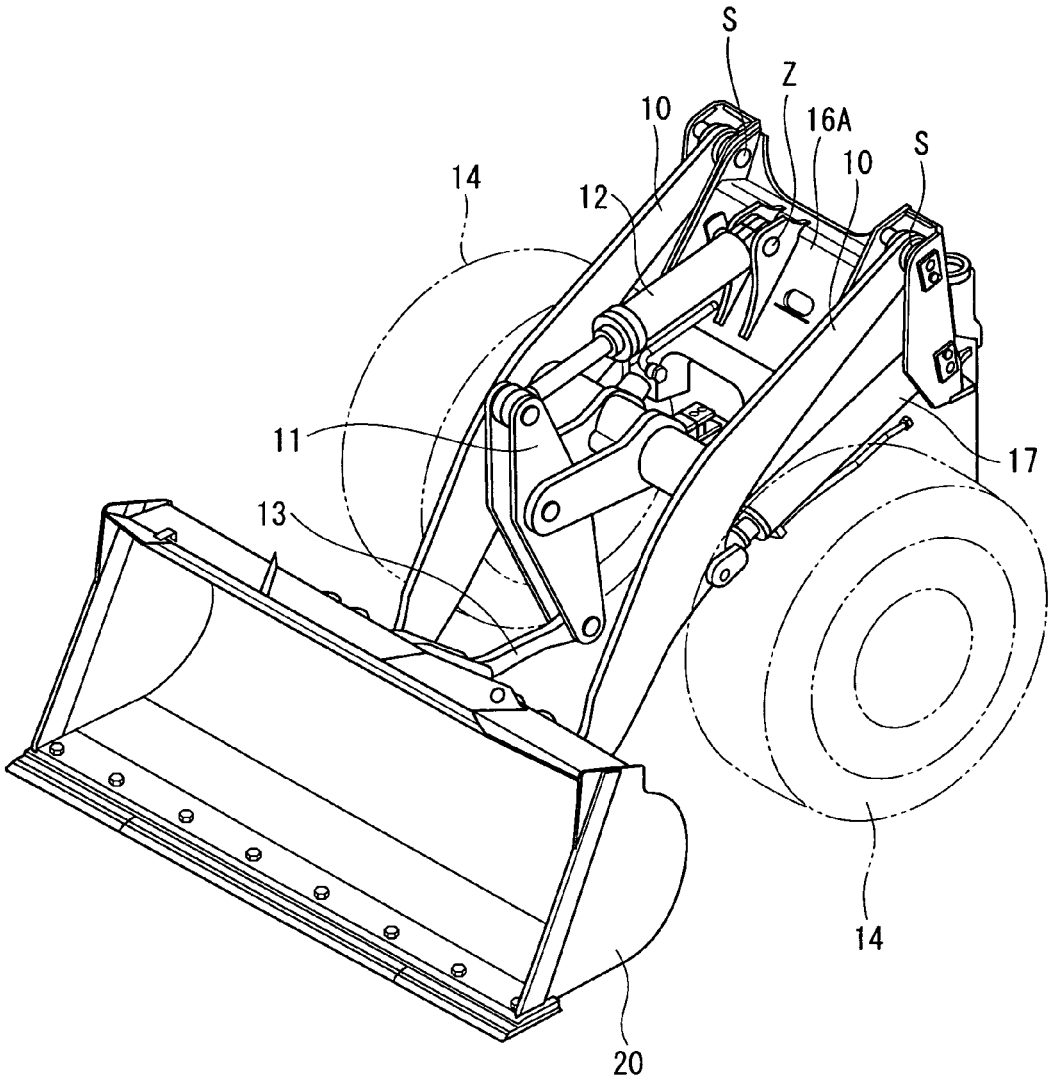
FIG. 2 is a perspective view showing the structure of the work machine according to the embodiment.

FIG. 1 is a side view showing a wheel loader (work machine) 1 according to the embodiment in its entirety. FIG. 2 is an external perspective of a working equipment 2 of the wheel loader 1. Here, the working equipment 2 refers to a portion except for a structural body 16A in FIG. 2. In each figure, the same reference numerals are assigned to the same components described in the background art.

The wheel loader 1 has: a vehicle body 16 which is self-propelled with front tires 14 and rear tires 15; a structural body 16A which supports the working equipment 2, the working equipment 2 including a bucket 20 in front of the vehicle body 16 (left side in the figure); a boom 10 which drives the bucket 20; and a Z-shaped link mechanism.

A base end of the boom 10 is pivoted on the structural body 16A so that the boom 10 is driven by the boom cylinder 17, and the bucket 20 is pivoted on a distal end of the boom 10. The Z-shaped link mechanism type link mechanism includes a bell crank 11 pivoted on a location halfway in a longitudinal direction of the boom 10, a tilt cylinder 12 for driving an upper end (an upper end when the bucket 20 is on ground) of the bell crank 11, and a connecting link 13 for linking a lower end of the bell crank 11 with the bucket 20. The tilt cylinder 12 is attached in such manner as to connect the bell crank 11 and the structural body 16A.

In this case, the base end of the tilt cylinder 12 is pivoted on the structural body 16A, and a pivot region Z of the tilt cylinder 12 relative to the structural body 16A is determined at such position that does not allow an angle of a lower surface 21 of the bucket 20 to alter between the ground position and the maximum height position when the boom 10 is elevated. Specifically, the pivot region Z is determined at a location forward and downward to a pivot region S of the boom 10 relative to the structural body 16A so that the trajectory of a pivot region W of the bell crank 11 relative to the tilt cylinder 12 is described around the pivot region Z. Accordingly, the angle characteristic of the bucket 20 in a horizontal state or a tilted state at the ground position is improved.

On the other hand, in the above wheel loader 1, the bell crank 11 is so arranged that an angle θ formed on the bucket 20 side by a first line segment L1 and a second line segment L2 belongs to a range represented by the following formula (1), the first line segment L1 connecting the pivot region Y of the bell crank 11 relative to the boom 10 and the pivot region X thereof relative to the connecting link 13, and the second line segment L2 connecting the pivot region W thereof relative to the tilt cylinder 12 and the pivot region Y.

$$0\ (\text{deg}) < \theta \leqq 206.5\ (\text{deg}) \ldots (1) \qquad \text{Formula 1}$$

As shown in FIG. 1, given that the bucket 20 is on the ground horizontal position or the fork (not shown in FIG. 1) is on the ground horizontal position and that the lower surface 21 of the bucket 20 or the lower surface of the fork is on the ground, an acute angle α formed by a line segment L3 and the line segment L2, belongs to a range represented by the following formula (2) in the fork-attached state. The line segment L3 connects the pivot region Z of the tilt cylinder 12 relative to the structural body 16A and the pivot region W of the bell crank 11 relative to the tilt cylinder 12. The pivot region W is disposed at a distal end of the tilt cylinder 12.

$$\alpha \leqq 73.2\ (\text{deg}) \ldots (1) \qquad \text{Formula 2}$$

Here, in a link provided with a pin and an aperture, since an increased influence of friction hampers a smooth operation of the link when an angle between link arm members is 15 (deg) or less, it is preferable that the value of angle α exceed 15 (deg).

Furthermore, a line segment L4 which connects the pivot region Z and the pivot region S is inclined downward toward the bucket 20 to the horizontal plane H thereby, forming an angle β with the horizontal plane H. Incidentally, a value of the angle β is determined in the vicinity of 45 (deg) in the embodiment.

The angles θ and α are determined as follows.

Figure 3:
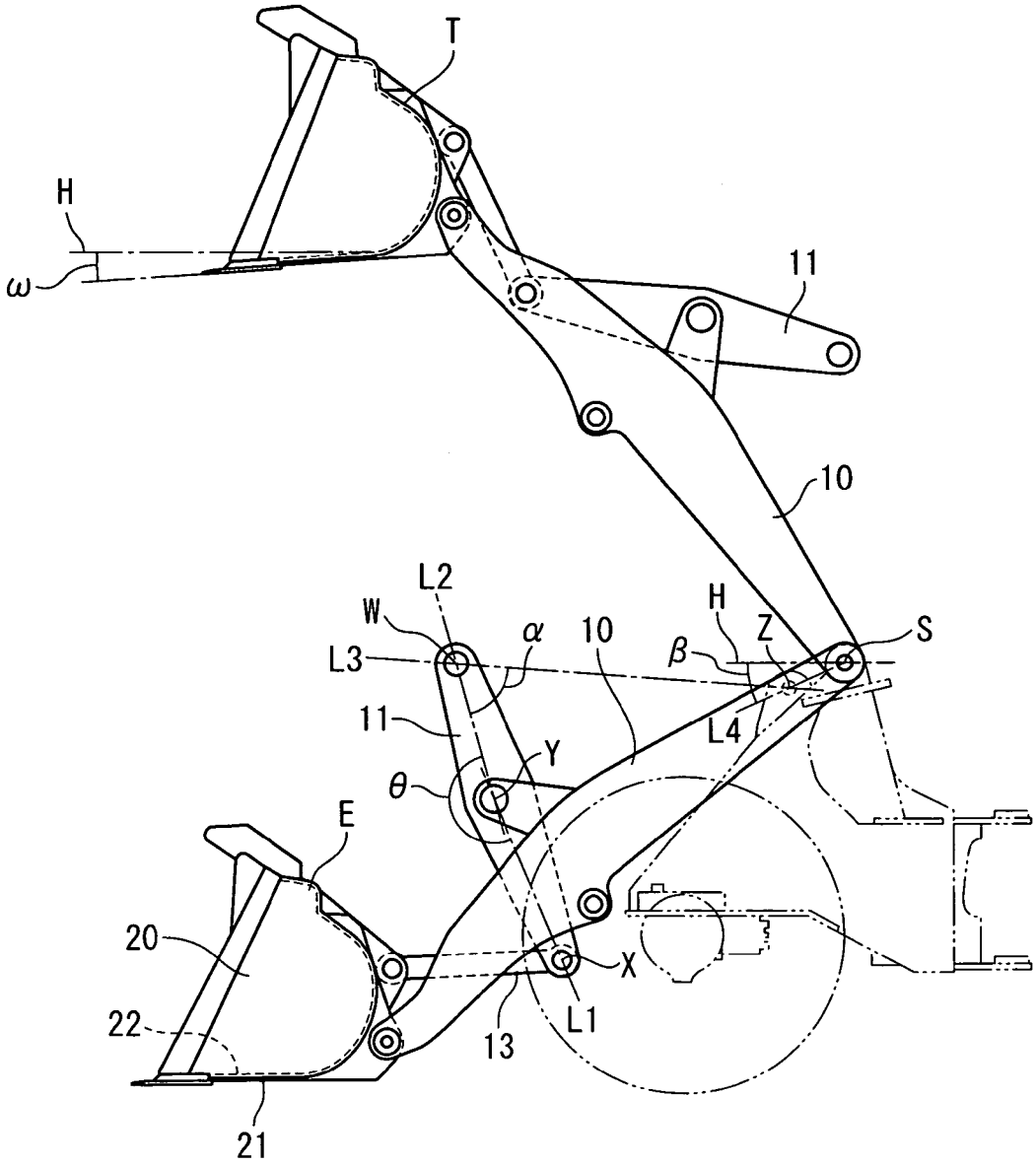
FIG. 3 is a schematic view showing a bucket of the work machine according to the embodiment at a ground horizontal position and a maximum height position.

As shown in FIG. 3, if earth and sand loaded in the bucket 20 slides down when the bucket 20 is lifted to a maximum height position, earth and sand cannot be loaded to the loading space of the dump truck or the like. First, a consideration will be given to this problem below.

A consideration will be given to the change in the downward angle ω formed between a distal end of the lower surface 21 of the bucket 20 and the bucket 20 when the bucket 20 is lifted from the ground horizontal position E to a maximum height position T only by the boom cylinder 17 without extending or retracting the tilt cylinder 12 in FIG. 3.

Figure 4:
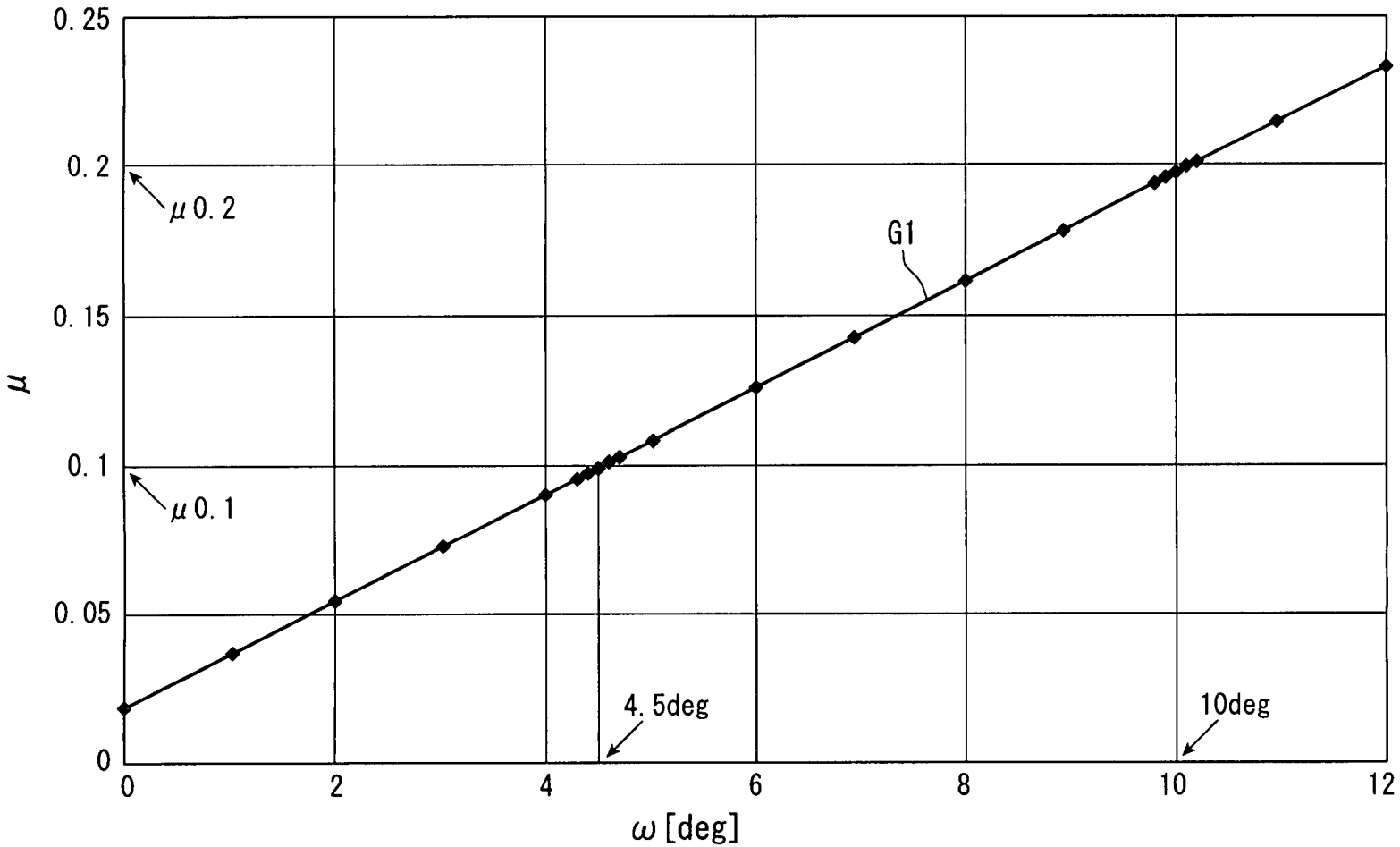
FIG. 4 is a schematic view showing a relationship between a downward angle and a maximum static friction coefficient of the bucket according to the embodiment.

A condition required to keep earth and sand from sliding down when the downward angle ω of the distal end of the lower surface 21 of the bucket 20 is changed will be derived from a relationship expressed by a graph G1 shown in FIG. 4 in which a maximum coefficient μ of static friction applied between the earth and sand and the inner bottom surface 22 (see FIG. 3) increases as the downward angle ω increases. The relationship can be expressed by the following formula (3), provided that W is a mass of a load, g is the gravitational acceleration, and b is a horizontal acceleration.

$$W \cdot g \cdot \sin\omega + W \cdot b \cdot \cos\omega = (W \cdot g \cdot \cos\omega - W \cdot b \cdot \sin\omega) * \mu \qquad (3)$$

Here, an acceleration at which the wheel loader 1 recedes, that is, the acceleration applied to the bucket 20 in a horizontally backward direction, is approximately 0.02 G to 0.1 G. However, when the wheel loader 1 recedes after having dumped earth, soil, and the like into a loading space of a truck, the acceleration can be assumed to be 0.02 G because the receding operation is conducted carefully to avoid interference between the bucket 20 and the loading space of the truck. Accordingly, FIG. 4 shows a relationship between the downward angle ω and the maximum static friction coefficient t on a condition that the acceleration being 0.02 G.

The maximum coefficient μ of static friction between the earth and sand and the inner bottom surface 22 of the bucket 20 can be adjusted by painting or roughening the inner bottom surface 22. However, if used for a long time, the inner bottom surface 22 will be worn out, so that the maximum static friction coefficient It will be close to that of a steel material constituting the bucket 20. Thus, the normal maximum static friction coefficient μ is assumably set at 0.1 to prevent the earth, soil, and the like from sliding down.

Nevertheless, in the case of earth and sand having a large friction coefficient such as clay soil, the maximum static friction coefficient μ is assumed to be around 0.2, which is larger than the normal coefficient. Also, when the wheel loader is receded after having dumped the earth and sand to the truck, the wheel loader is receded while maintaining a gap of a reasonable size between the loading space of the truck and the bucket 20. Furthermore, load leveling operation can be performed even if an angle of the lower surface 21 of the bucket 20 is not precisely horizontal.

With reference to FIG. 4 assuming that the maximum static friction coefficient μ is around 0.2 from what has been described above, it should be understood that, unless the downward angle ω of the bucket 20 is 10 (deg) or less, the earth and sand loaded in the bucket 20 is more likely to slide down. Incidentally, in FIG. 4, the downward angle ω of 4.5 (deg) corresponds to the maximum static friction coefficient μ of 0.1.

Next, a consideration will be given to a relationship among the angle θ, the angle α, and the bucket 20 in the working equipment 2 attached with the fork when the angle θ is changed. In this case, an angle θ is changed while an upward angle ω' between the distal portion of a lower surface of the fork and the horizontal plane H at each of the ground horizontal position E, the intermediate position, and the maximum height position T remains unchanged. With regards to this, the wheel loader 1 used in the consideration will be initially described with reference to FIGS. 5 to 12. It should be noted that FIG. 5 to FIG. 12 are schematic views showing the working equipment 2, in which symbols already mentioned in FIGS. 1 to 3 are partially omitted for convenience of visualization.

Two types, namely a type A and a type B, of the wheel loaders 1 which is different from each other in vehicle size will be examined. The type A wheel loader 1 is given an angle θ of 188.0 (deg) and an angle α of 58.5 (deg) in a fork-attached state. The type B wheel loader 1 is given an angle θ of 191.4 (deg) and an angle α of 61.0 (deg).in the fork-attached state. Both the type A wheel loader 1 and the type B wheel loader 1 are given an angle β of around 45 (deg).

The two types of the wheel loaders 1 possess the following features.

Figure 5:
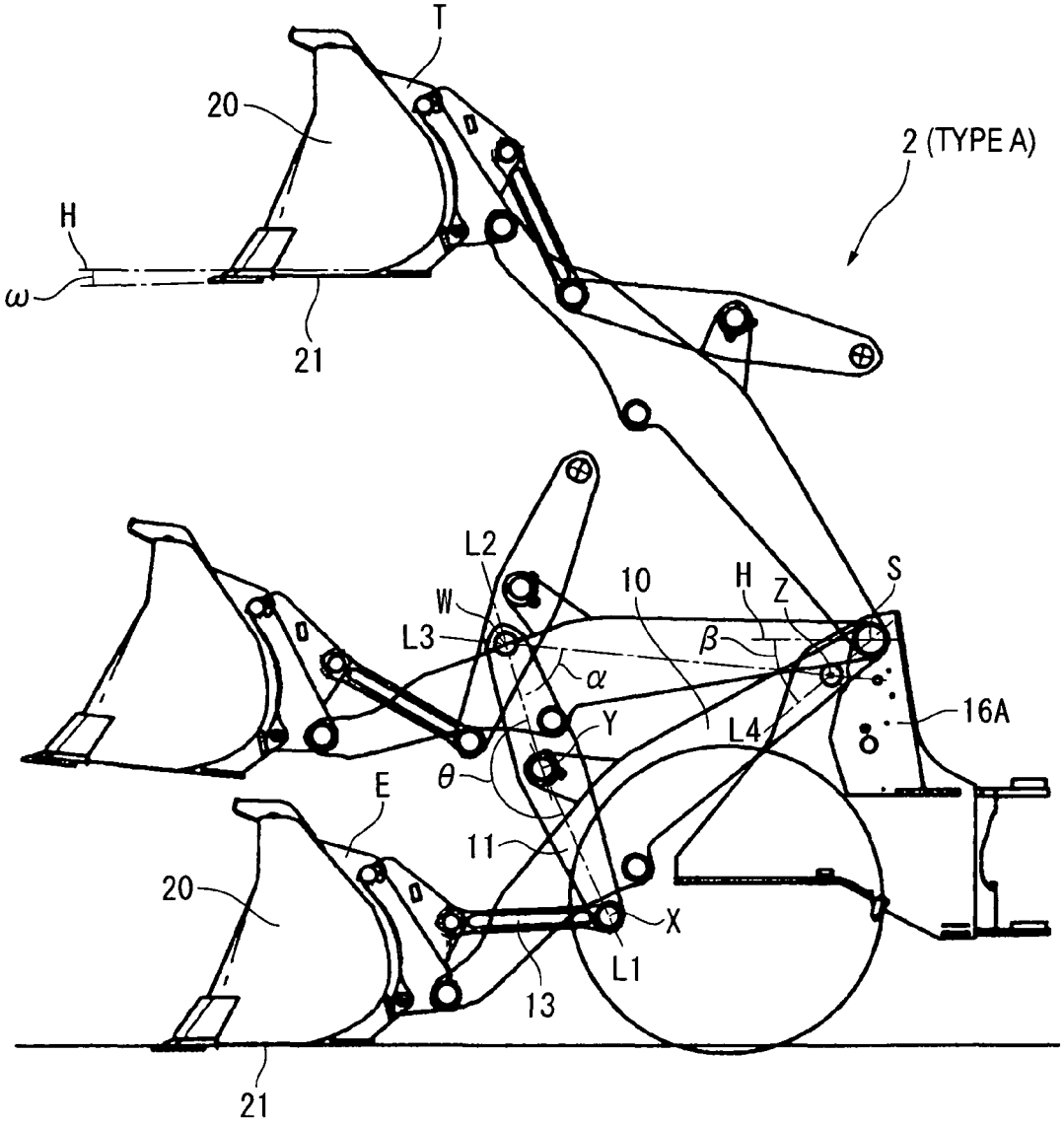
FIG. 5 is a schematic view showing a type A work machine in a bucket-attached state according to in the embodiment in which the bucket is at the ground horizontal position, an intermediate position, and the maximum height position.
Figure 9:
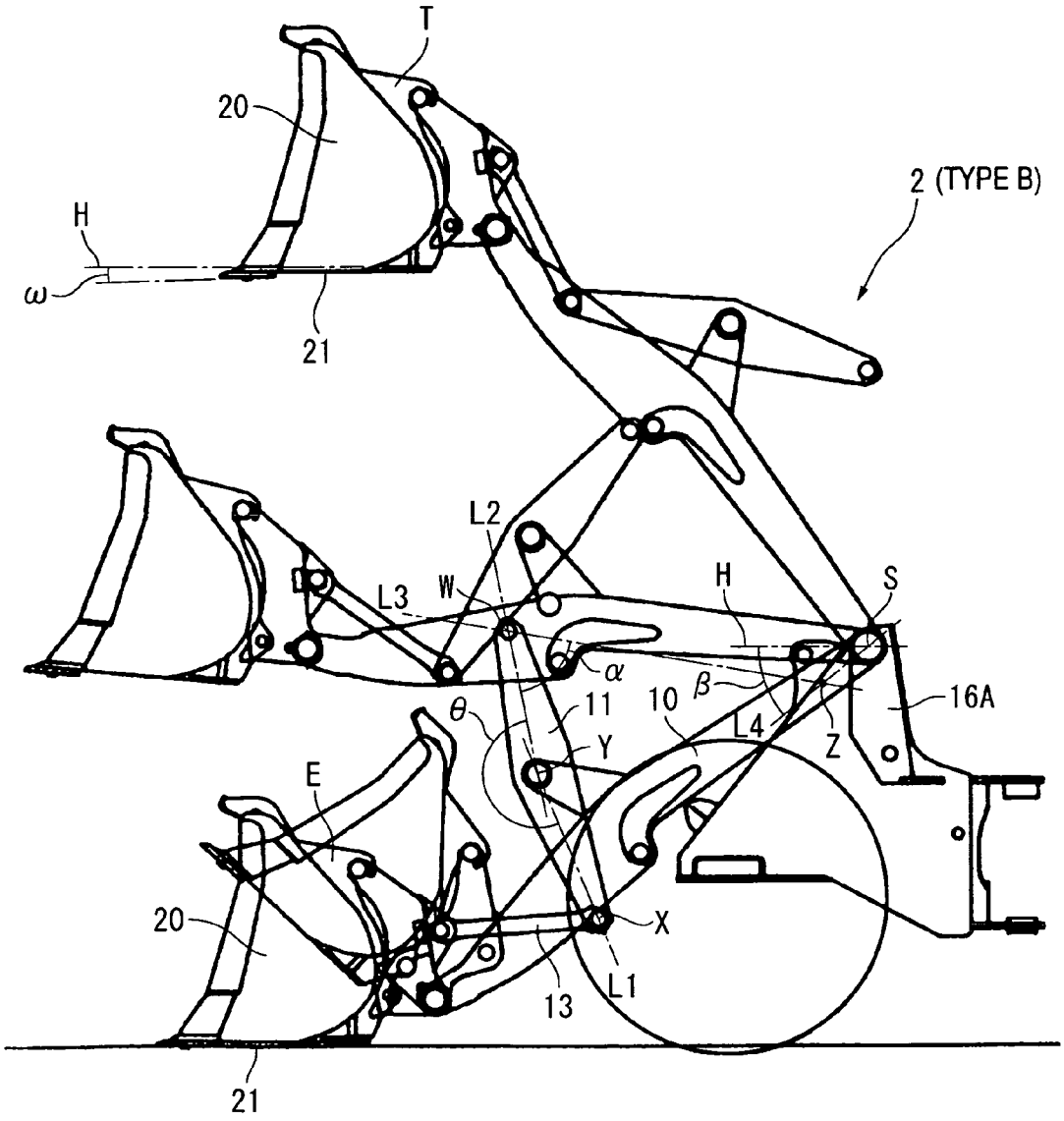
FIG. 9 is a schematic view showing a type B work machine in a bucket-attached state according to the embodiment in which the bucket is at the ground horizontal position, the intermediate position, and the maximum height position.

When the bucket 20 is attached, since the lower surface 21 of the bucket 20 at the maximum height position T thereof is substantially horizontal as shown in FIG. 5 (type A) and FIG. 9 (type B), the loading operation can be conducted at an intended height while earth, sand, and the like is prevented from dropping from the bucket 20 during an elevation of the boom 10.

Figure 6:
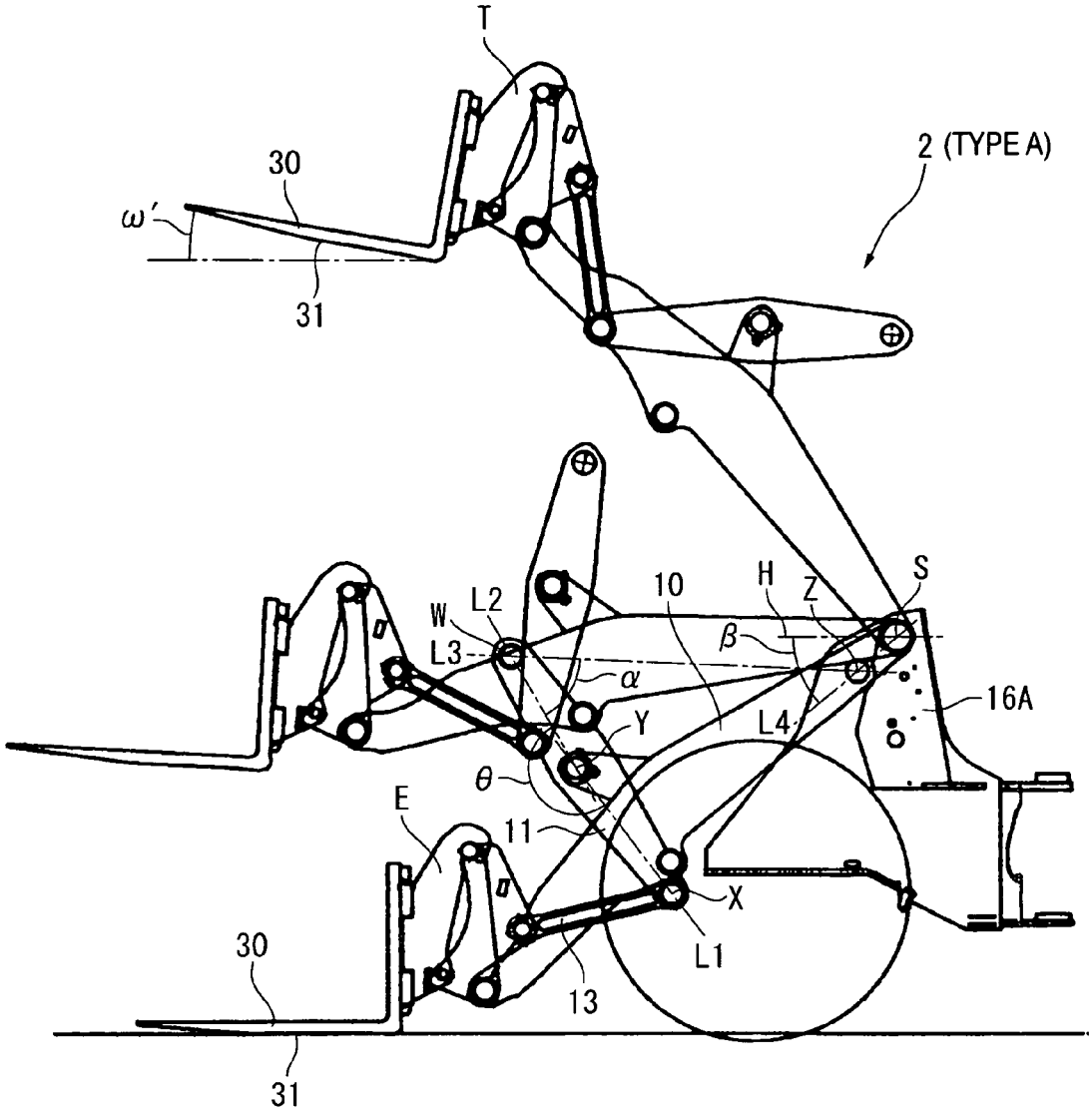
FIG. 6 is a schematic view showing the type A work machine in a fork-attached state according to the embodiment in which the fork is at ground horizontal position, the intermediate position, and the maximum height position.
Figure 10:
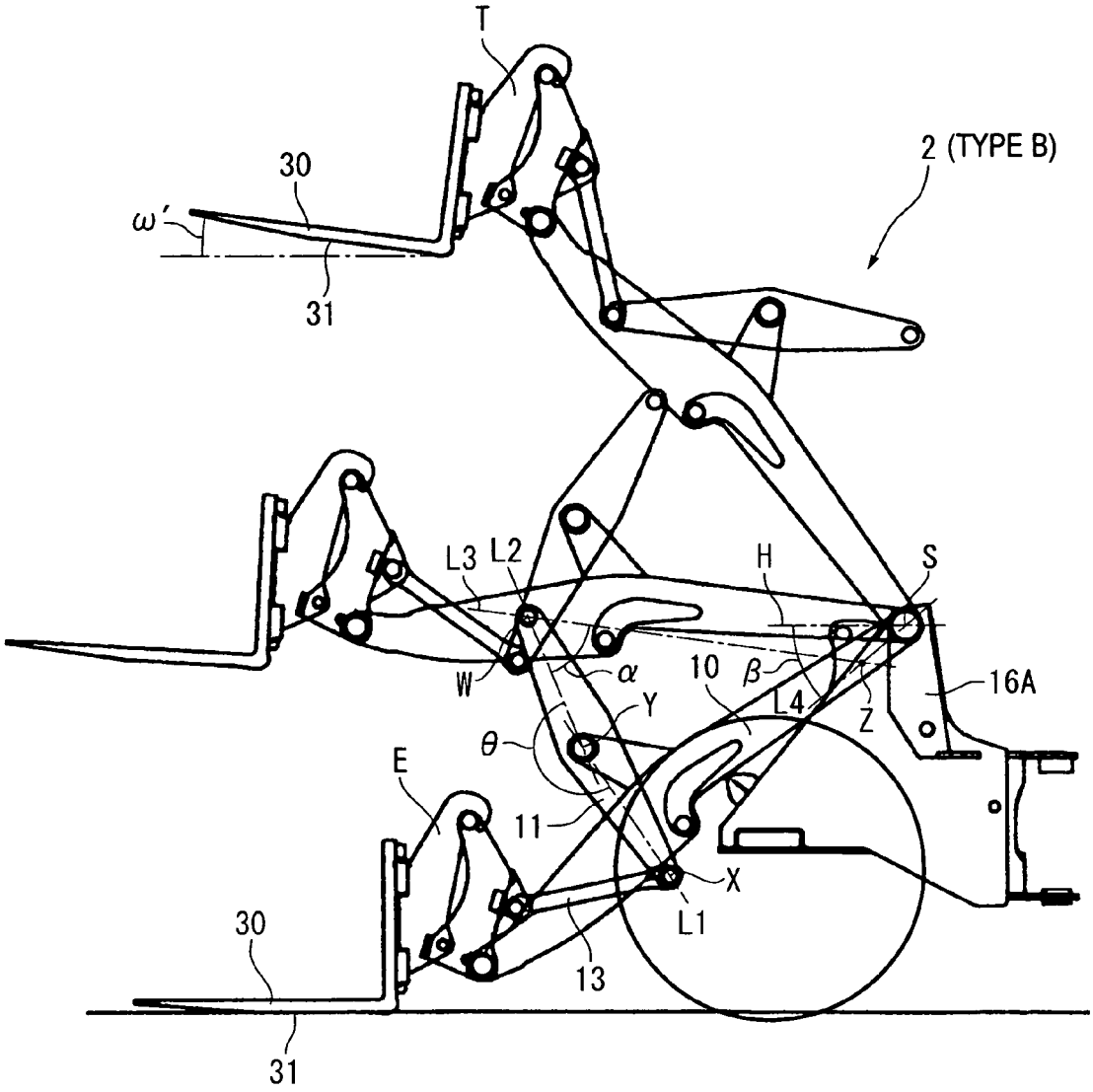
FIG. 10 is a schematic view showing the type B work machine in the fork-attached state according to the embodiment in which the fork is at the ground horizontal position, the intermediate position, and the maximum height position.

On the other hand, when the fork 30 is attached, the upward angle ω' between the distal portion of the lower surface 31 of the fork 30 and a horizontal plane H is monotonically increased in accordance with the elevation of the boom 10 without being downwardly reduced as shown in FIG. 6 (type A) and FIG. 10 (type B), thereby reliably preventing a loaded object from being dropped halfway. The upward angle ω' between the lower surface 31 of the fork 30 and the horizontal surface H at the maximum height position T is 10 (deg) or less, so that the working equipment 2 exhibits sufficient parallel elevation characteristics.

Figure 7:
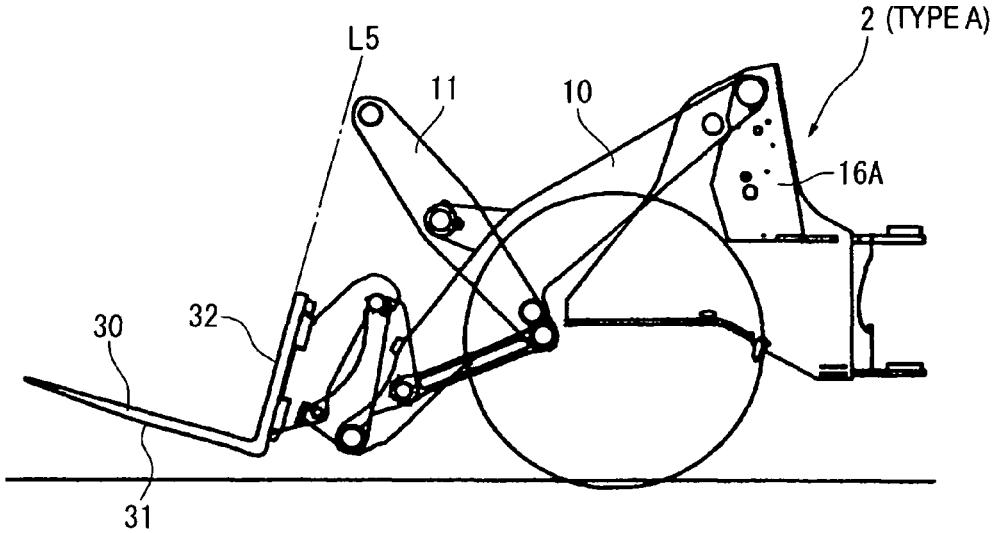
FIG. 7 is a schematic view showing the type A work machine in the fork-attached state according to the embodiment in which the fork is fully tilted from the ground horizontal position.
Figure 11:
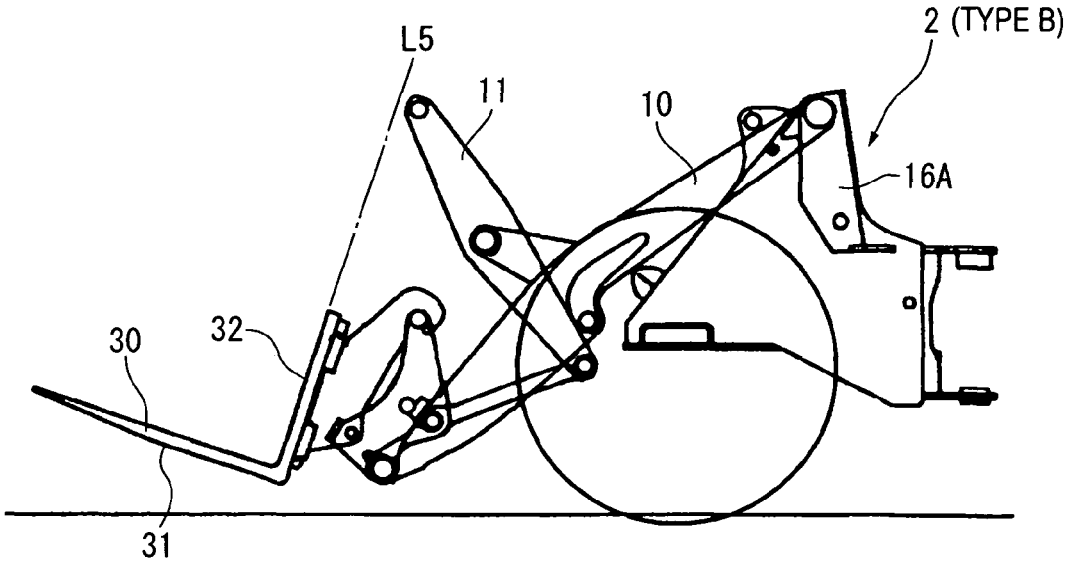
FIG. 11 is a schematic view showing the type B work machine in the fork-attached state according to the embodiment in which the fork is fully tilted from the ground horizontal position.

As shown in FIG. 7 (type A) and FIG. 11 (type B), when the fork 30 is disposed at the ground horizontal position E (see FIG. 6 and FIG. 10) and the lower surface 31 of the fork 30 fully tilted from the ground position by extending the tilt cylinder 12, the entire bell crank 11 is located adjacent to the structural body 16A relative to an extension line L5, the extension line L5 extending upward from a rear surface 32 of the fork 30. Accordingly, even if the fork 30 is fully tilted in the fork 30-attached state, a load on the fork 30 does not interfere with the bell crank 11.

Figure 8:
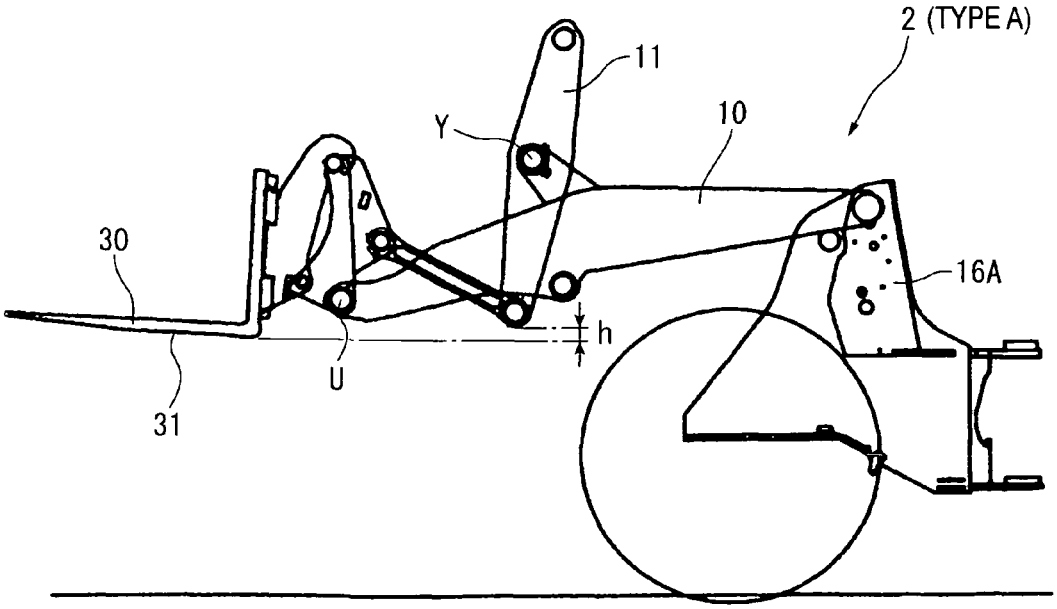
FIG. 8 is a schematic view showing the type A work machine in the fork-attached state according to the embodiment in which the fork is at a height of a normal loading operation.
Figure 12:
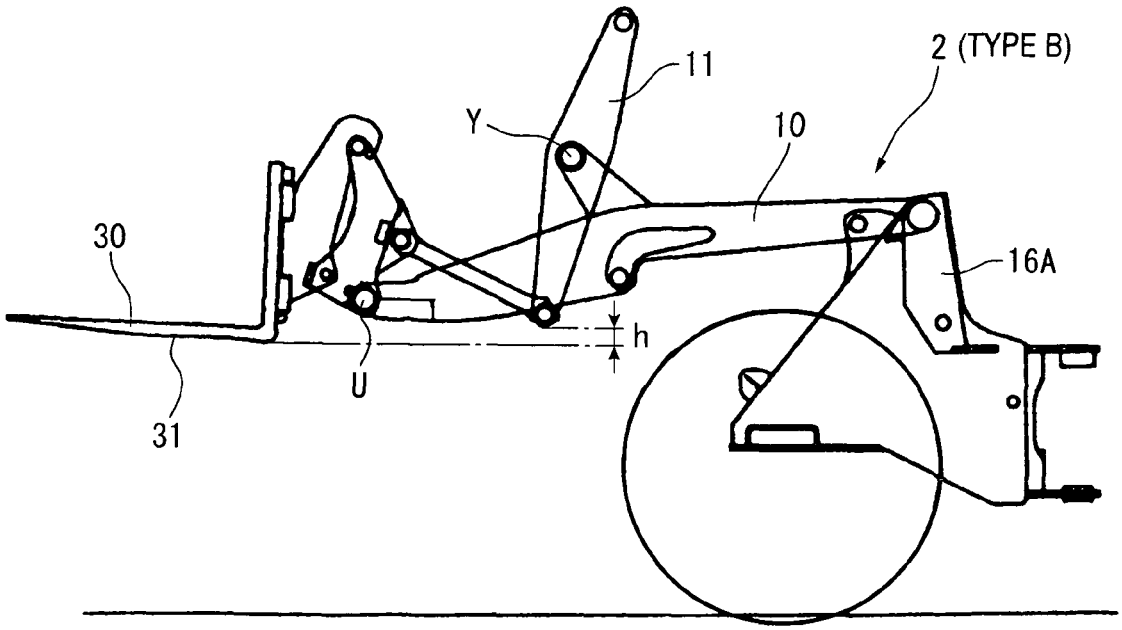
FIG. 12 is a schematic view showing the type B work machine in the fork-attached state according to the embodiment in which the fork is at a height of a normal loading operation.

Moreover, when the normal loading height in the fork 30-attached state, in other words, the height of the pivot region U of the fork 30 relative to the boom 10 is approximately 1.5 m from the ground as shown in FIG. 8 (type A) and FIG. 12 (type B), the lower end of the bell crank 11 is disposed higher than the lower surface 31 of the fork 30 by a distance h. Accordingly, during the loading operation of loads, the loading vehicle and the lower end of the bell crank 11 are not likely to interfere.

In the above consideration, the above wheel loader 1 underwent a simulation with various values of the angle θ. Specifically, in the fork 30-attached state, when the angle θ is varied while the upward angle ω' between the distal portion of the lower surface 31 of the fork 30 and the horizontal plane H at each of the ground horizontal position, the intermediate position, and the maximum height position remains unchanged irrespective of the changes of the angle θ, the pivot region Z of the tilt cylinder 12 relative to the structural body 16A, around which the trajectory of the pivot region W of the bell crank 11 relative to the tilt cylinder 12 is described, and is moved in accordance with the changes of the angle θ. In addition, in accordance with the above, the angle α also is changed. At this time, a relationship between the angle α in the fork-30 attached state and the downward angel ω of the bucket 20 at the maximum height position T is represented by graphs G2 and 63 shown in FIG. 13.

Figure 13:
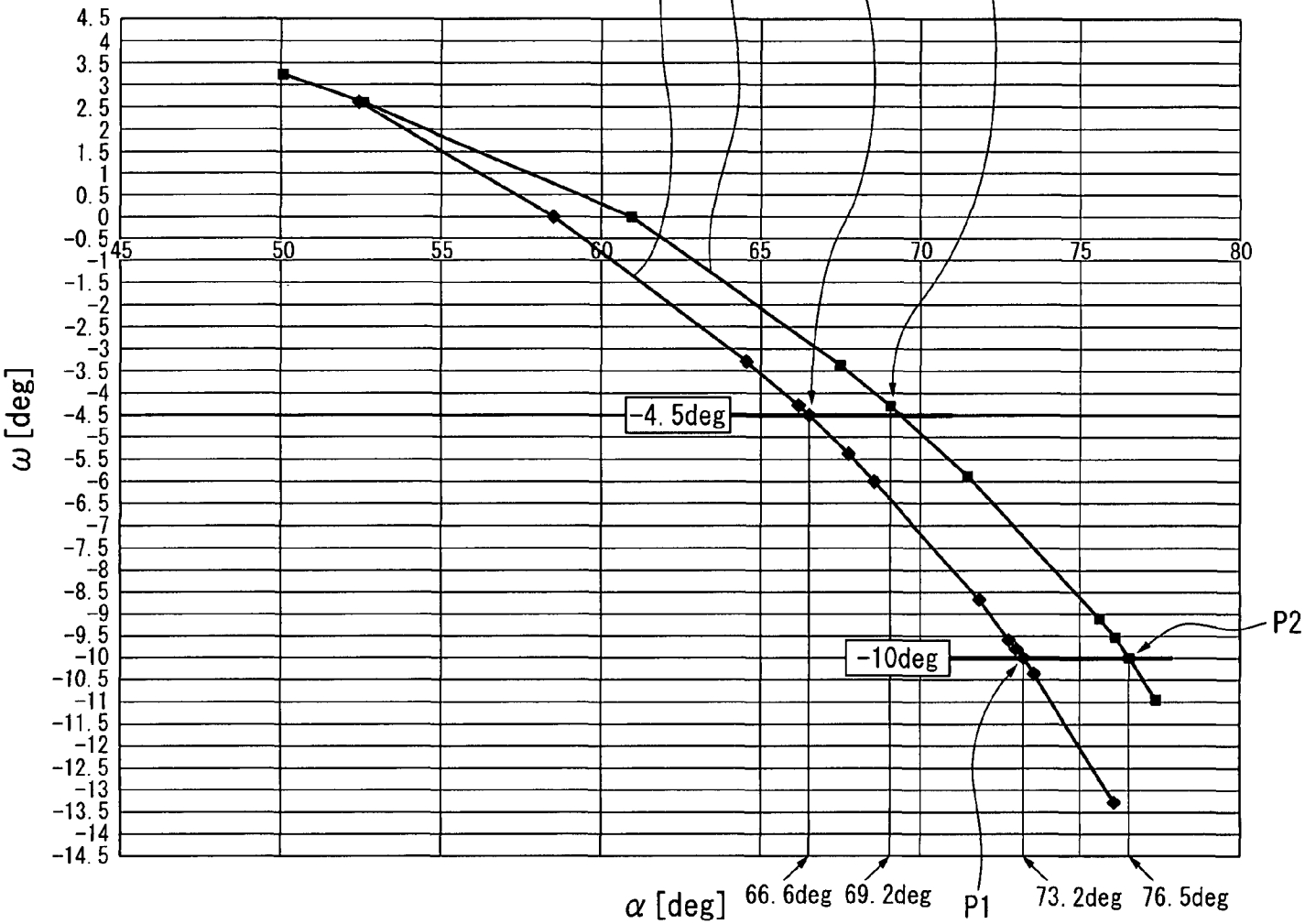
FIG. 13 is a graph showing a relationship between an angle α and a downward angle ω at the maximum height position according to the embodiment.

Here, in FIG. 13, G2 is a graph of the type A and G3 is a graph of the type B. Also, with regards to the downward angle ω of the bucket 20 on the vertical axis in FIG. 13, ω<0 (deg) means that the distal end of the lower surface 21 of the bucket 20 is below the horizontal plane, while ω>0 (deg) means that the distal end of the lower surface 21 of the bucket 20 is above the horizontal plane H.

According to the graphs G2 and G3 shown in FIG. 13, in order to set the downward angle ω of the bucket 20 at the maximum height position to be 10 (deg) or less in either type of the wheel loaders 1, the angle α in the fork 30-attached state needs to be 73.2 (deg) or less.

Figure 14:
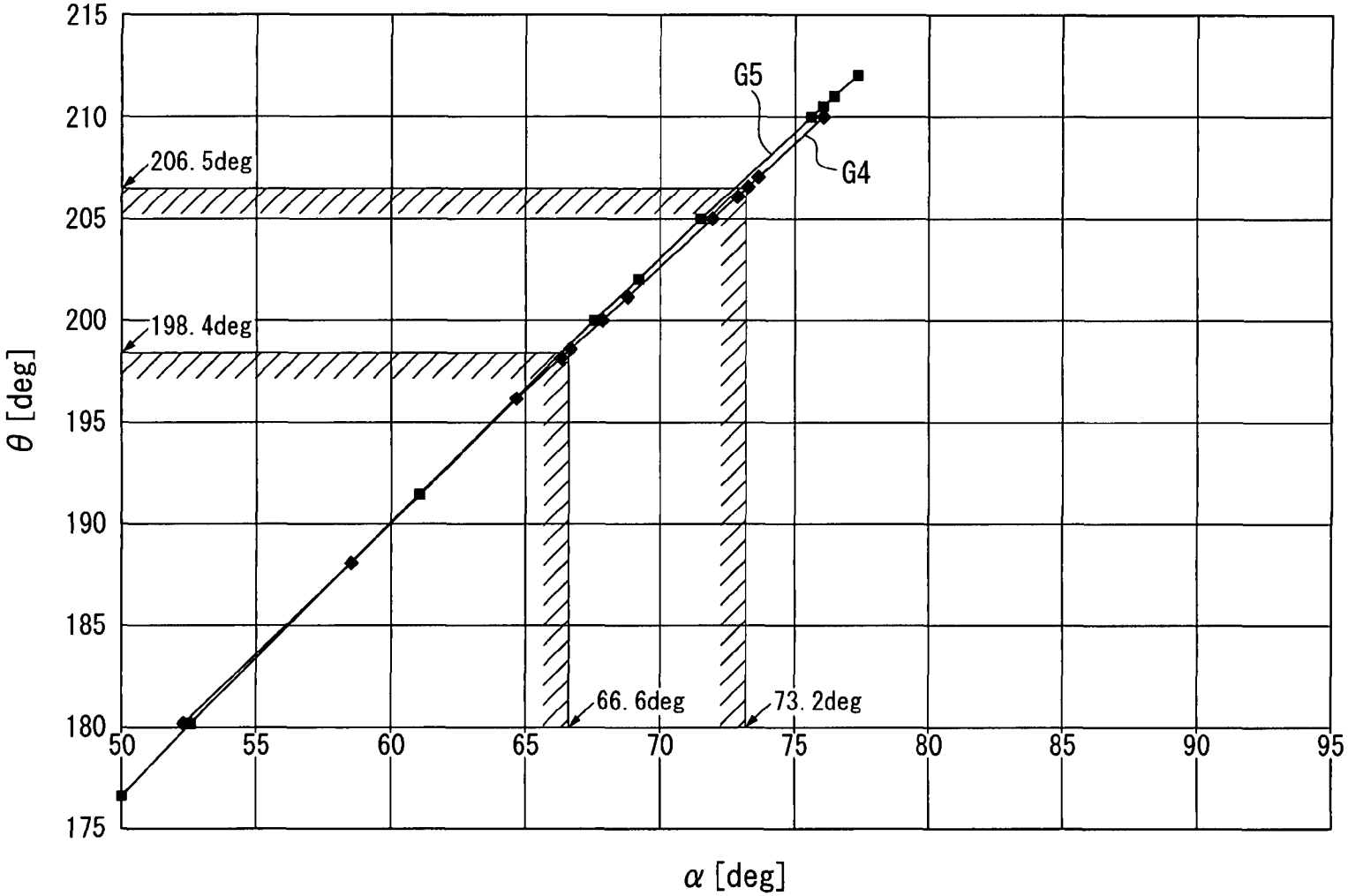
FIG. 14 is a graph showing a relationship between the angle α and an angle θ according to the embodiment.
Figure 15:
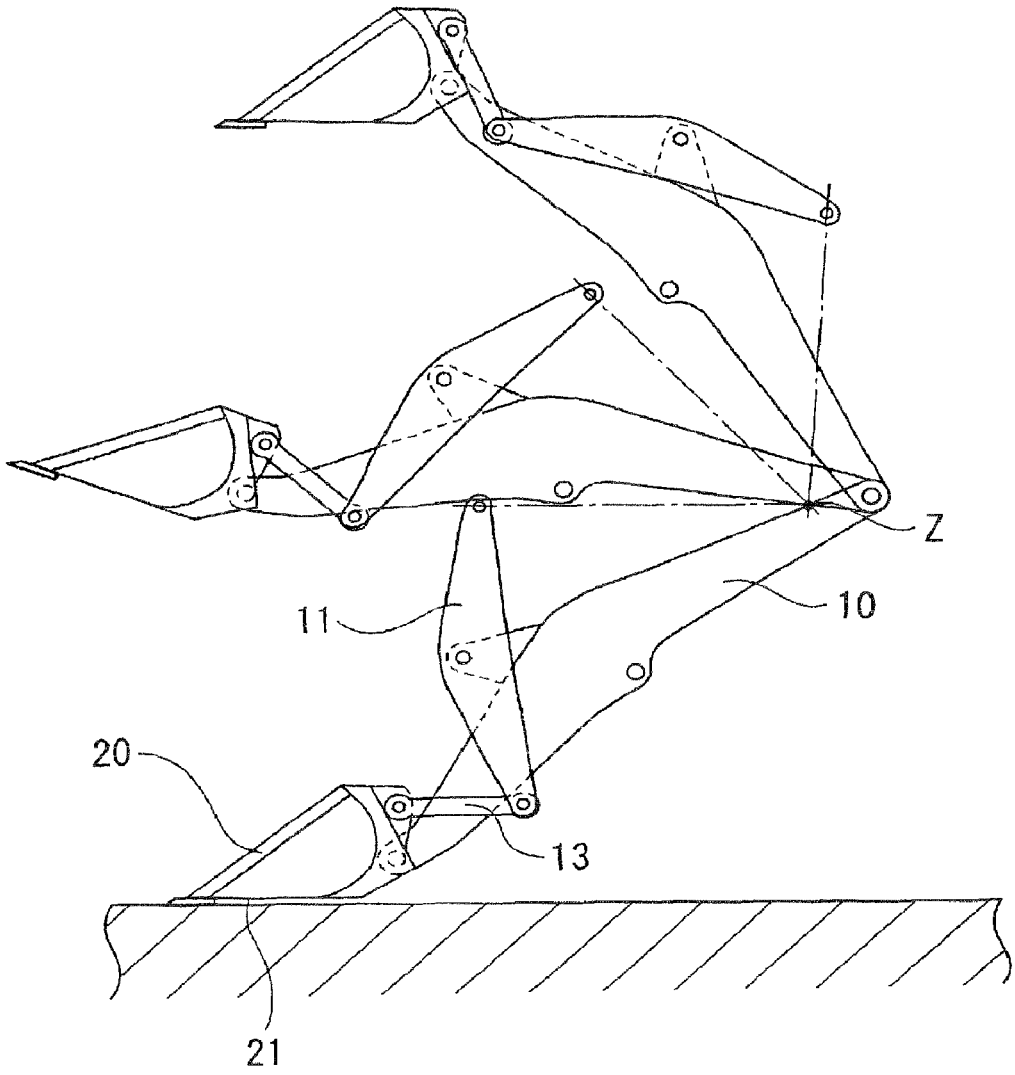
FIG. 15 PRIOR ART
FIG. 15 is a schematic view showing a structure of a conventional Z-shaped link.

The relationship between the angle α and the angle θ of the bell crank 11 in the type A and the type B in this simulation are given by graphs G4 and G5 in FIG. 14. Here, in FIG. 14, G4 is a graph of the type A and G5 is a graph of the type B. With regards to the angle θ on the vertical axis in FIG. 14, θ>180 (deg) represents that the bell crank is in a "<" shape with the open end facing the structural body 16A, while θ<180 (deg) represents that the bell crank 11 is in a ">" shape with the open end facing the bucket 20.

As a result of the simulation, when the downward angles ω of the bucket 20 at the maximum height position T become approximately 10 (deg), specifically a value of a point P1 (type A) and a value of a point P2 (type B), the angle θ is 206.5 (deg) for the type A while 211.0 (deg) for the type B. Accordingly, in order to set the angle α in the fork 30-attached state to be 73.2 (deg) or less in both types of the wheel loaders 1, the angle θ needs to be 206.5 (deg) or less.

In each type, the upward angle ω' between the distal portion of the lower surface 31 of the fork 30 and the horizontal plane H was 10 (deg) or less at the maximum height position T.

Incidentally, it is known from FIG. 13 that, in order to set the downward angle ω of the bucket 20 at the maximum height position T to be 4.5 (deg) or less, the angle α in the fork-30-attached state needs to be 66.6 (deg) or less. The angle θ corresponding to the above downward angle ω, specifically the angles θ of the points P3 (type A) and P4 (type B) on the graphs in FIG. 13 are 198.4 (deg) for the type A and 202.0 (deg) for the type B respectively. Thus, the angle θ needs to be 198.4 (deg) or less.

From what has been described above, the downward angle ω of the bucket 20 at the maximum height position shown in FIG. 3 can be set to be 10 (deg) or less under conditions of the angle θ satisfying the formula (1) and the angle α in the fork 30-attached state satisfying the formula (2). Therefore, the bucket 20 can be lifted to the maximum height position T without adjusting an amount of extension and retraction of the tilt cylinder 12 while earth and sand is prevented from sliding down from the bucket 20. Furthermore, since the lower end of the bell crank 11 is located higher than the lower end of the lower surface 31 of the fork 30 at the normal loading height of the fork 30-attached state, the bell crank 11 does not interfere with the loading vehicle during the loading operation of loads, thereby enabling an efficient loading operation.

The scope of the invention is not limited to the above-described embodiments but includes various variations and improvements as long as an object of the present invention can be achieved.

The present invention is applied to the wheel loader 1 in the embodiment, but the present invention is not limited thereto and can be applied to any suitable work machine as long as the work machine is equipped with a so-called Z-shaped link.

The angle θ and the angle α in the present invention are not limited to what has been described in the above embodiment but can employ various combinations as far as the above described conditions are satisfied.

Specific structures, shapes, and the like of the present invention may be other structures and the like as far as an object of the present invention is achieved.

The invention claimed is:

1. A work machine, comprising:

a working equipment;

a structural body that supports the working equipment;

a boom having a first end which is attached to the structural body;

a bucket and a fork which are exchangeably attachable to a second end of the boom;

a bell crank attached to a location between the ends of the boom in a longitudinal direction of the boom;

a tilt cylinder having a first end which is pivoted on the structural body, and a second end which is attached to a first end of the bell crank; and a connecting link that connects a second end of the bell crank and the bucket or the fork, wherein when the bucket or the fork attached to the second end of the boom is at a ground horizontal position and a lower surface of the bucket or a lower surface of the fork is on the ground: the tilt cylinder is attached to an upper end portion of the bell crank, and the connecting link is connected to a lower end portion of the bell crank;

wherein the bell crank is attached to the boom, the connecting link is connected to the second end of the bell crank and the second end of the tilt cylinder is attached to the first end of the bell crank such that when the bucket or the fork attached to the second end of the boom is at the ground horizontal position and the lower surface of the bucket or the lower surface of the fork is on the ground: an angle θ formed on a side of the bucket or on a side of the fork by a first line segment that connects a pivot region of the bell crank relative to the boom and a pivot region of the bell crank relative to the connecting link and a second line segment that connects the pivot region of the bell crank relative to the boom and a pivot region of the bell crank relative to the tilt cylinder satisfies $180° < \theta \leqq 206.5°$;

wherein the bell crank is attached to the boom, the first end of the tilt cylinder is pivotally connected to the structural body and the second end of the tilt cylinder is attached to the first end of the bell crank such that when the fork is attached to the second end of the boom and is at the ground horizontal position and the lower surface of the fork is on the ground: an angle α formed by the second line segment and a third line segment that connects the pivot region of the bell crank relative to the tilt cylinder and a pivot region of the tilt cylinder relative to the structural body satisfies, $53.0° < \alpha < 73.2°$;

wherein the fork, the boom and the bell crank are structured and arranged such that when the fork is attached to the second end of the boom and a pivot region of the fork relative to the boom is substantially 1.5 m high from the ground, a lower end of the bell crank is located higher than a lower end of the fork;

wherein, when the fork is positioned at the ground horizontal position and the lower surface of the fork is fully tilted from the ground horizontal position, the entire bell crank is located adjacent to the structural body relative to an extension line that extends upward from a rear surface of the fork;

wherein, when the bucket or the fork attached to the second end of the boom is at the ground horizontal position and the lower surface of the bucket or the lower surface of the fork is on the ground: a fourth line segment that connects the pivot region of the tilt cylinder to the structural body and a pivot region of the boom to the structural body is inclined downward toward the bucket or toward the fork relative to a horizontal plane;

wherein an angle β formed between the fourth segment and the horizontal plane is determined in the vicinity of 45 (deg) toward the bucket or toward the fork; and wherein when the bucket is at a maximum height position, a downward angle ω between a distal end of the lower surface of the bucket and a horizontal plane satisfies $\omega \leqq 10°$.

2. A work machine, comprising:

a working equipment;

a structural body that supports the working equipment;

a boom having a first end which is attached to the structural body;

a bucket and a fork which are exchangeably attachable to a second end of the boom;

a bell crank attached to a location between the ends of the boom in a longitudinal direction of the boom;

a tilt cylinder having a first end which is pivoted on the structural body, and a second end which is attached to a first end of the bell crank; and a connecting link that connects a second end of the bell crank and the bucket or the fork, wherein when the bucket or the fork attached to the second end of the boom is at a ground horizontal position and a lower surface of the bucket or a lower surface of the fork is on the ground: the tilt cylinder is attached to an upper end portion of the bell crank, and the connecting link is connected to a lower end portion of the bell crank;

wherein the bell crank is attached to the boom, the connecting link is connected to the second end of the bell crank and the second end of the tilt cylinder is attached to the first end of the bell crank such that when the bucket or the fork attached to the second end of the boom is at the ground horizontal position and the lower surface of the bucket or the lower surface of the fork is on the ground: an angle θ formed on a side of the bucket or on a side of the fork by a first line segment that connects a pivot region of the bell crank relative to the boom and a pivot region of the bell crank relative to the connecting link and a second line segment that connects the pivot region of the bell crank relative to the boom and a pivot region of the bell crank relative to the tilt cylinder satisfies $180° < \theta \leqq 198.4°$;

wherein the bell crank is attached to the boom, the first end of the tilt cylinder is pivotally connected to the structural body and the second end of the tilt cylinder is attached to the first end of the bell crank such that when the fork is attached to the second end of the boom and is at the ground horizontal position and the lower surface of the fork is on the ground: an angle α formed by the second line segment and a third line segment that connects the pivot region of the bell crank relative to the tilt cylinder and a pivot region of the tilt cylinder relative to the structural body satisfies, $53.0° \leqq \alpha \leqq 66.6°$;

wherein the fork, the boom and the bell crank are structured and arranged such that when the fork is attached to the second end of the boom and a pivot region of the fork relative to the boom is substantially 1.5 m high from the ground, a lower end of the bell crank is located higher than a lower end of the fork;

wherein, when the fork is positioned at the ground horizontal position and the lower surface of the fork is fully tilted from the ground horizontal position, the entire bell crank is located adjacent to the structural body relative to an extension line that extends upward from a rear surface of the fork;

wherein, when the bucket or the fork attached to the second end of the boom is at the ground horizontal position and the lower surface of the bucket or the lower surface of the fork is on the ground: a fourth line segment that connects the pivot region of the tilt cylinder to the structural body and a pivot region of the boom to the structural body is inclined downward toward the bucket or toward the fork relative to a horizontal plane;

wherein an angle $\beta$ formed between the fourth segment and the horizontal plane is determined in the vicinity of 45 (deg) toward the bucket or toward the fork; and wherein when the bucket is at a maximum height position, a downward angle $\omega$ between a distal end of the lower surface of the bucket and a horizontal plane satisfies $\omega < 4.5°$.

* * * * *